US010481551B2

(12) United States Patent
Yamamoto

(10) Patent No.: US 10,481,551 B2
(45) Date of Patent: Nov. 19, 2019

(54) IMAGE FORMING APPARATUS WITH PIVOTABLE TRANSFER UNIT POSITIONING PORTION

(71) Applicant: CANON KABUSHIKI KAISHA, Tokyo (JP)

(72) Inventor: Shinkichi Yamamoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/810,544

(22) Filed: Nov. 13, 2017

(65) Prior Publication Data

US 2018/0150021 A1 May 31, 2018

(30) Foreign Application Priority Data

Nov. 25, 2016 (JP) ..... 2016-229463

(51) Int. Cl.
*G03G 21/16* (2006.01)

(52) U.S. Cl.
CPC ..... *G03G 21/168* (2013.01); *G03G 21/1609* (2013.01); *G03G 21/1633* (2013.01); *G03G 21/1647* (2013.01); *G03G 2221/169* (2013.01); *G03G 2221/1642* (2013.01); *G03G 2221/1654* (2013.01); *G03G 2221/1687* (2013.01)

(58) Field of Classification Search
CPC ..... G03G 21/1609; G03G 21/1633; G03G 21/1647; G03G 21/168; G03G 2221/1642; G03G 2221/1654; G03G 2221/1687; G03G 2221/169
See application file for complete search history.

(56) References Cited

U.S. PATENT DOCUMENTS

| | | | | |
|---|---|---|---|---|
| 7,302,209 | B2 | 11/2007 | Kurita | |
| 7,386,255 | B2 | 6/2008 | Ochi | |
| 7,979,000 | B2 | 7/2011 | Sekina et al. | |
| 2014/0140727 | A1* | 5/2014 | Shimoi | G03G 21/1633 399/121 |
| 2015/0220050 | A1* | 8/2015 | Fukase | G03G 21/1647 399/110 |
| 2017/0060078 | A1* | 3/2017 | Uohashi | G03G 21/1633 |
| 2018/0024472 | A1* | 1/2018 | Sato | G03G 21/1647 399/121 |

FOREIGN PATENT DOCUMENTS

| | | | |
|---|---|---|---|
| JP | 2006-048004 | A | 2/2006 |
| JP | 2007-047571 | A | 2/2007 |
| JP | 2009-251135 | A | 10/2009 |
| JP | 2010-015060 | A | 1/2010 |

* cited by examiner

*Primary Examiner* — Joseph S Wong
(74) *Attorney, Agent, or Firm* — Venable LLP

(57) ABSTRACT

An image forming apparatus includes an apparatus body including an image bearing member configured to bear a toner image, a transfer unit including a transfer portion configured to transfer the toner image borne on the image bearing member onto a sheet, the transfer unit being pivotably supported with respect to the apparatus body, an opening/closing unit disposed at a position farther from the apparatus body than the transfer unit is, and openably and closably supported with respect to the apparatus body, and a positioning portion pivotably supported with respect to the apparatus body and configured to position the transfer unit with respect to the apparatus body. The positioning portion is entirely disposed further on an outer side in the apparatus body than a pivot center of the transfer unit in a horizontal direction.

11 Claims, 8 Drawing Sheets

80
94
90
84
91
84b
96
84a
92
93
83
66
60
6
62

7
90
80
60
85
1A
R4
1
10
62
64

IMAGE FORMING APPARATUS WITH PIVOTABLE TRANSFER UNIT POSITIONING PORTION

BACKGROUND OF THE INVENTION

Field of the Invention

The present invention is related to an image forming apparatus configured to form an image on a sheet.

Description of the Related Art

Generally, as an image forming apparatus of an electrophotographic system, for example, a printer that transfers a toner image formed on an intermediate transfer belt onto a sheet by a transfer roller is known. The transfer roller is provided in a transfer unit pivotably supported with respect to an apparatus body, and a sheet nipped by the intermediate transfer belt and the transfer roller can be removed by separating the transfer unit from the apparatus body together with the transfer roller.

Conventionally, as illustrated in FIG. 8B, a printer including a secondary transfer locking arm 202 such that a secondary transfer unit 230 pivots along with an opening/closing operation of a side cover 290 is proposed in Japanese Patent Laid-Open No. 2009-251135. The side cover 290 is supported to be openable and closable about a pivot center 291 with respect to an apparatus body, and is configured to press the secondary transfer unit 230 with a secondary transfer unit pressing member 293. The secondary transfer unit 230 is supported to be pivotable about a pivot center 230*b* with respect to the apparatus body, and is configured such that the secondary transfer roller 232 is capable of coming into contact with and being separated from the intermediate transfer belt provided in the apparatus body.

A secondary transfer arm 292 on which a guide cam 292*a* is formed is provided on the side cover 290, and an engagement projection 202*d* of the secondary transfer locking arm 202 is guided by the guide cam 292*a* when the side cover 290 is opened or closed. When the side cover 290 is closed, the guide cam 292*a* guides the engagement projection 202*d*, and thus the secondary transfer locking arm 202 pivots upward in an arrow C1 direction of FIG. 8A. As a result of this, an engagement portion 202*b* formed on the secondary transfer locking arm 202 engages with a positioning portion 230*a* of the secondary transfer unit 230, and thus the secondary transfer unit 230 can be positioned.

In recent years, it has been desired that an image forming apparatus such as a printer is miniaturized so as to reduce a space required for installation as much as possible. However, in the image forming apparatus disclosed in Japanese Patent Laid-Open No. 2009-251135 described above, a pivot center 202*a* of the secondary transfer locking arm 202 is disposed further on the inside of the apparatus body than the secondary transfer unit 230. Therefore, components such as a secondary transfer belt, photosensitive drums, and a fixing unit need to be disposed further on the inside of the apparatus body than the pivot center 202*a* of the secondary transfer locking arm 202, and this causes the size of the apparatus body to be larger.

SUMMARY OF THE INVENTION

According to a first aspect of the present invention, an image forming apparatus includes an apparatus body including an image bearing member configured to bear a toner image, a transfer unit including a transfer portion configured to transfer the toner image borne on the image bearing member onto a sheet, the transfer unit being pivotably supported with respect to the apparatus body such that the transfer portion is capable of coming into contact with and being separated from the image bearing member, an opening/closing unit disposed at a position farther from the apparatus body than the transfer unit is, and openably and closably supported with respect to the apparatus body, and a positioning portion pivotably supported with respect to the apparatus body and configured to position the transfer unit with respect to the apparatus body. The positioning portion is entirely disposed further on an outer side in the apparatus body than a pivot center of the transfer unit in a horizontal direction.

According to a second aspect of the present invention, an image forming apparatus includes an apparatus body including an image bearing member configured to bear a toner image, a transfer unit including a transfer portion configured to transfer the toner image borne on the image bearing member onto a sheet, the transfer unit being pivotably supported with respect to the apparatus body such that the transfer portion is capable of coming into contact with and being separated from the image bearing member, an opening/closing unit disposed at a position farther from the apparatus body than the transfer unit is, and openably and closably supported with respect to the apparatus body, and a positioning portion pivotably supported with respect to the apparatus body and configured to position an abutting portion of the transfer unit with respect to a fixed portion provided in the apparatus body. The positioning portion includes a first engagement portion extending toward a first side from a pivot center of the positioning portion, a second engagement portion extending toward a second side from the pivot center of the positioning portion, and a pressing portion extending toward a third side different from the first side and the second side from the pivot center of the positioning portion, and configured to press the abutting portion of the transfer unit against the fixed portion. The opening/closing unit includes a third engagement portion configured to press the first engagement portion and cause the positioning portion to pivot such that the pressing portion is separated from the abutting portion in a course of a closing operation of the opening/closing unit, and a fourth engagement portion configured to engage with the second engagement portion and cause the positioning portion to pivot such that the pressing portion approaches the abutting portion in a course of the closing operation of the opening/closing unit.

Further features of the present invention will become apparent from the following description of exemplary embodiments with reference to the attached drawings.

DESCRIPTION OF THE EMBODIMENTS

Preferable exemplary embodiments of the present invention will be described in detail below with reference to drawings. To be noted, the dimensions, materials, shapes, and positional relationships of constituents that will be described in the exemplary embodiments below should be appropriately changed in accordance with the configurations and various conditions of apparatuses to which the present invention is applied. Therefore, the scope of the present invention should not be limited to the exemplary embodiments unless a particularly limiting description is given. Copiers, printers, multifunctional devices having functions of these machines, and so forth may serve as image forming apparatuses according to the exemplary embodiments of the present invention. In the exemplary embodiments below, descriptions will be given by taking a laser beam printer as an example. To be noted, components unnecessary for description are not illustrated.

First Exemplary Embodiment

Overall Configuration

Figure 1:
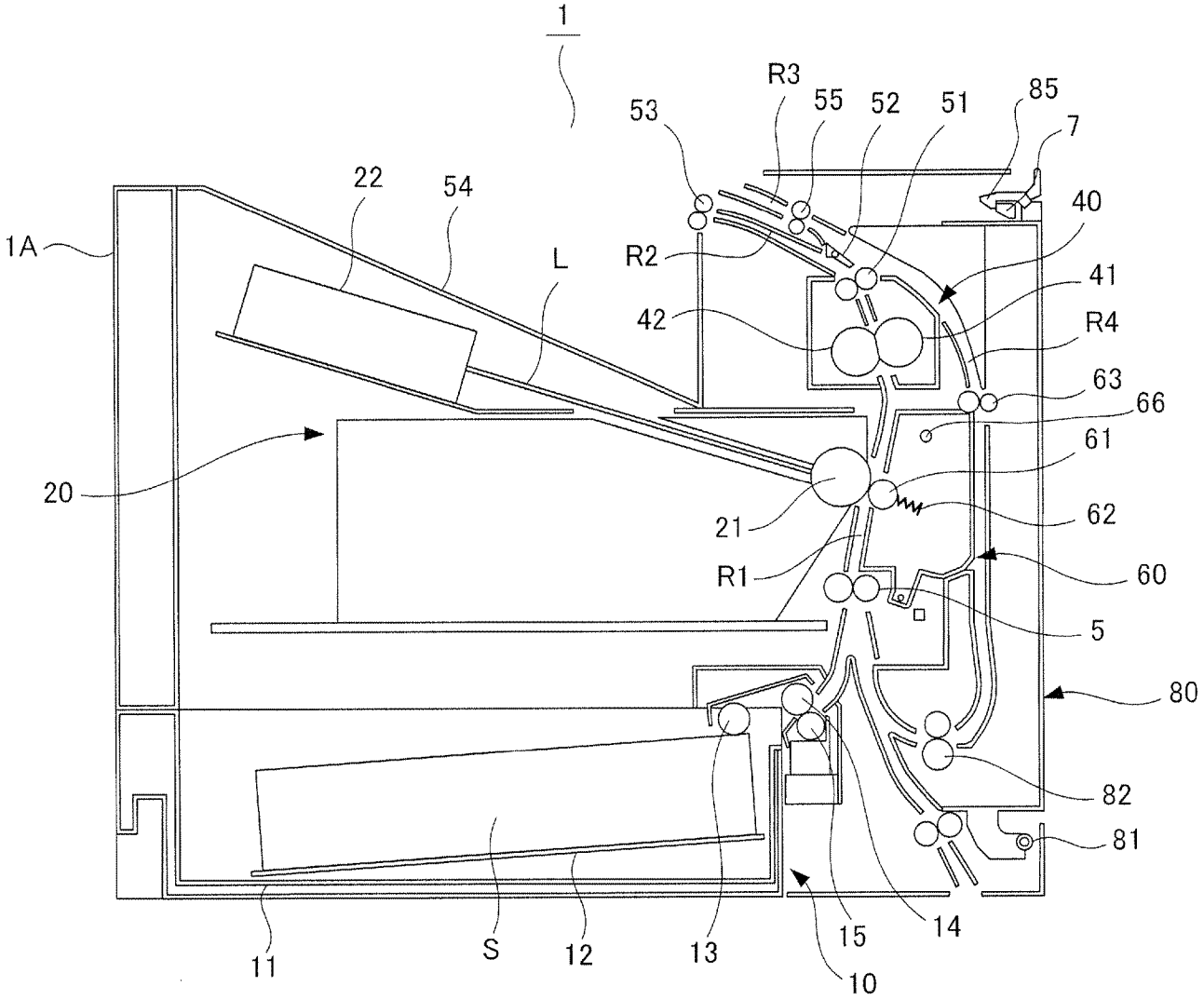
FIG. 1 is an overall schematic view of a printer according to a first exemplary embodiment.

First, a first exemplary embodiment of the present invention will be described. A printer 1 serving as an image forming apparatus is a laser beam printer of an electrophotographic system that forms a monochromatic toner image. As illustrated in FIG. 1, the printer 1 includes a sheet feed portion 10, an image forming portion 20, a fixing unit 40, a transfer unit 60, and a side door 80. The sheet feed portion 10 feeds a supported sheet, the image forming portion 20 forms an image to be transferred onto the sheet, and the fixing unit 40 fixes the transferred image onto the sheet. The side door 80 serves as an opening/closing unit openably and closably provided with respect to an apparatus body 1A of the printer 1.

When an instruction for image formation is output to the printer 1, the image forming portion 20 starts an image formation process on the basis of image information input from, for example, an external computer connected to the printer 1. The image forming portion 20 includes an exposure unit 22, a photosensitive drum 21, and a charging portion, a developing portion, and a cleaning portion that are not illustrated. The photosensitive drum 21 is constituted by a metal cylinder and a photosensitive layer having a charging polarity and formed on the metal cylinder, and serves as an image bearing member that bears a toner image.

The exposure unit 22 radiates laser light L toward the photosensitive drum 21 on the basis of the input image information. At this time, the photosensitive drum 21 has been already charged by the charging portion, and an electrostatic latent image is formed on the photosensitive drum 21 as a result of being irradiated with the laser light L. Then, this electrostatic latent image is developed by the developing portion, and thus a monochromatic toner image is formed on the photosensitive drum 21.

In parallel with the image formation process described above, a sheet S accommodated in a cassette 11 of the sheet feed portion 10 is fed by a pickup roller 13. A plate 12 capable of ascending and descending is provided in the cassette 11, and the pickup roller 13 abuts the sheet S supported on the plate 12 when feeding the sheet S. In the case where plural sheets S are fed by the pickup roller 13, one sheet S is separated from the plural sheets S by a feed roller 14 and a retard roller 15, and the one sheet S is conveyed to a transfer conveyance path R1 toward a registration roller pair 5. To be noted, although a single cassette 11 is provided in the present exemplary embodiment, plural cassettes respectively accommodating sheets of different sizes may be provided, and a sheet may be fed in accordance with a sheet size selected among the different sizes corresponding to the plural cassettes.

The skew of the sheet S is corrected by the registration roller pair 5, and the sheet S is conveyed at a predetermined conveyance timing. Then, a toner image on the photosensitive drum 21 is transferred onto a front surface serving as a first surface of the sheet S by an electrostatic load bias applied to a transfer roller 61 of the transfer unit 60. Here, the transfer unit 60 includes a transfer roller spring 62 serving as a transfer urging portion that urges the transfer roller 61 toward the photosensitive drum 21. In order to securely transfer the toner image onto the sheet S, it is required to urge the transfer roller 61 serving as a transfer portion toward the photosensitive drum 21 by an appropriate transfer pressure, and, for this, it is required that the transfer unit 60 is precisely positioned with respect to the apparatus body 1A.

After the toner image is transferred onto the sheet S, a small amount of toner remains on the surface of the photosensitive drum 21, and the remaining toner is removed by the cleaning portion that is not illustrated. Then, the sheet S onto which the toner image has been transferred is subjected to predetermined heat and pressure from a pressurizing roller 41 and a heating roller 42 of the fixing unit 40, and the toner is fixed by being melted. The sheet S having passed through the fixing unit 40 is conveyed to a discharge conveyance path R2 by a conveyance roller pair 51, and is discharged onto a discharge tray 54 by a discharge roller pair 53.

In the case of forming images on both surfaces of the sheet S, a guide member 52 pivots downward, and the sheet S is guided to an inversion conveyance path R3. The sheet S guided to the inversion conveyance path R3 is switched back by an inversion roller pair 55, and is thus conveyed to a duplex conveyance path R4. The sheet S conveyed to the duplex conveyance path R4 is again conveyed to the transfer conveyance path R1 by conveyance roller pairs 63 and 82. Then, an image is also formed on a back surface serving as a second surface of the sheet S similarly to the first surface, and the sheet S is discharged onto the discharge tray 54.

Transfer Unit and Side Door

Figure 2:
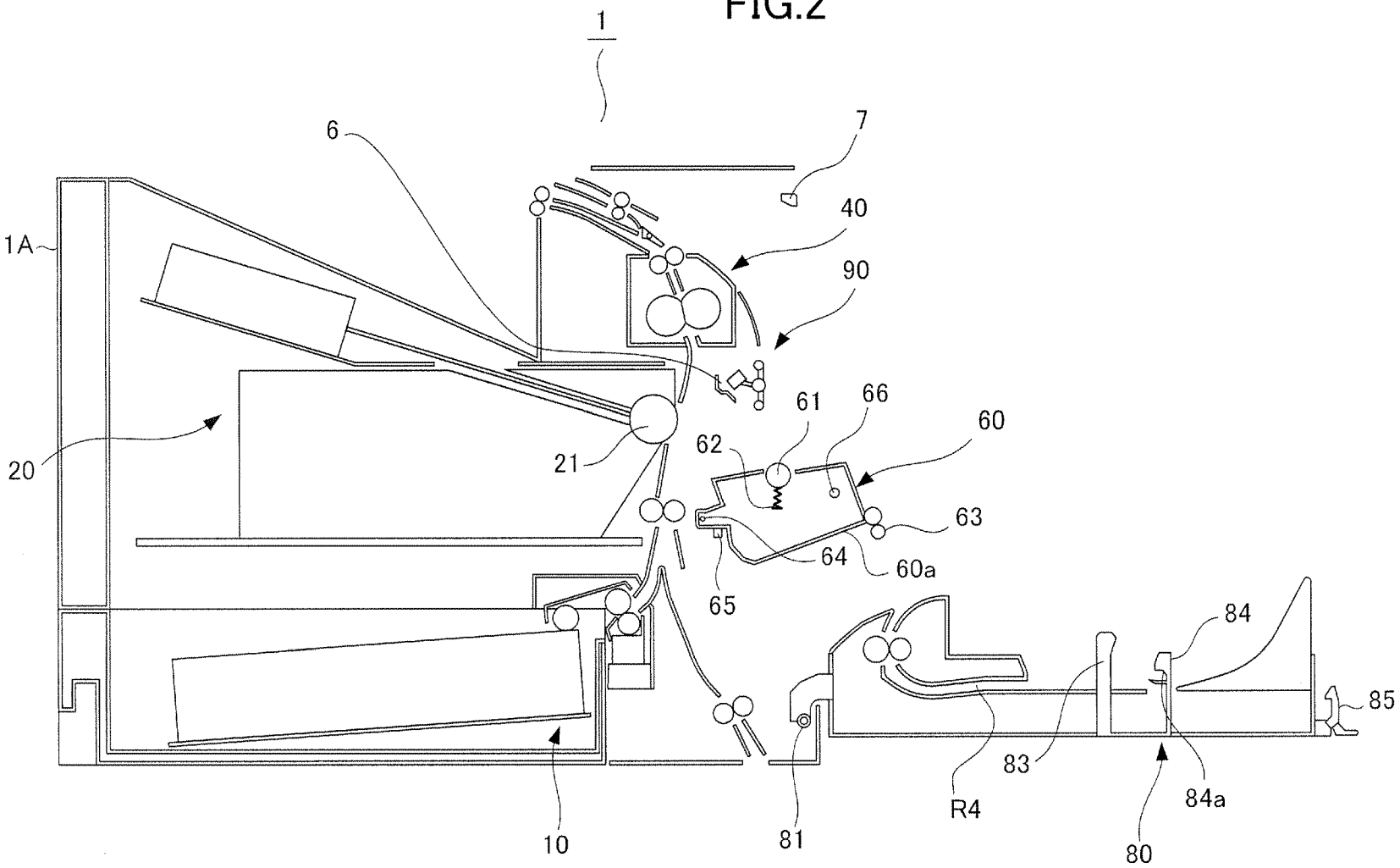
FIG. 2 is an overall schematic view of a printer in a state in which a side door and a transfer unit are open.

As illustrated in FIG. 2, the transfer unit 60 is supported on the apparatus body 1A so as to be pivotable about a pivot shaft 64 serving as a pivot center, and is configured such that the transfer roller 61 is capable of coming into contact with and being separated from the photosensitive drum 21. When the sheet is jammed in path between the photosensitive drum 21 and the transfer roller 61, the side door 80 and the transfer unit 60 are opened with respect to the apparatus body 1A, and the jammed sheet S is removed. At this time, the transfer unit 60 is held by a stopper 65 provided in the apparatus body 1A. A positioning pin 66 serving as an abutting portion projects from a frame 60*a* of the transfer unit 60 in a width direction of the sheet S. The transfer unit 60 is configured to be positioned with respect to the apparatus body 1A as a result of the positioning pin 66 being pressed against a body-side positioning portion 6 serving as a fixed portion provided in the apparatus body 1A with a high precision when the side door 80 is in a closed state. That is, the positioning pin 66 is configured to be capable of abutting the body-side positioning portion 6.

Figure 3:
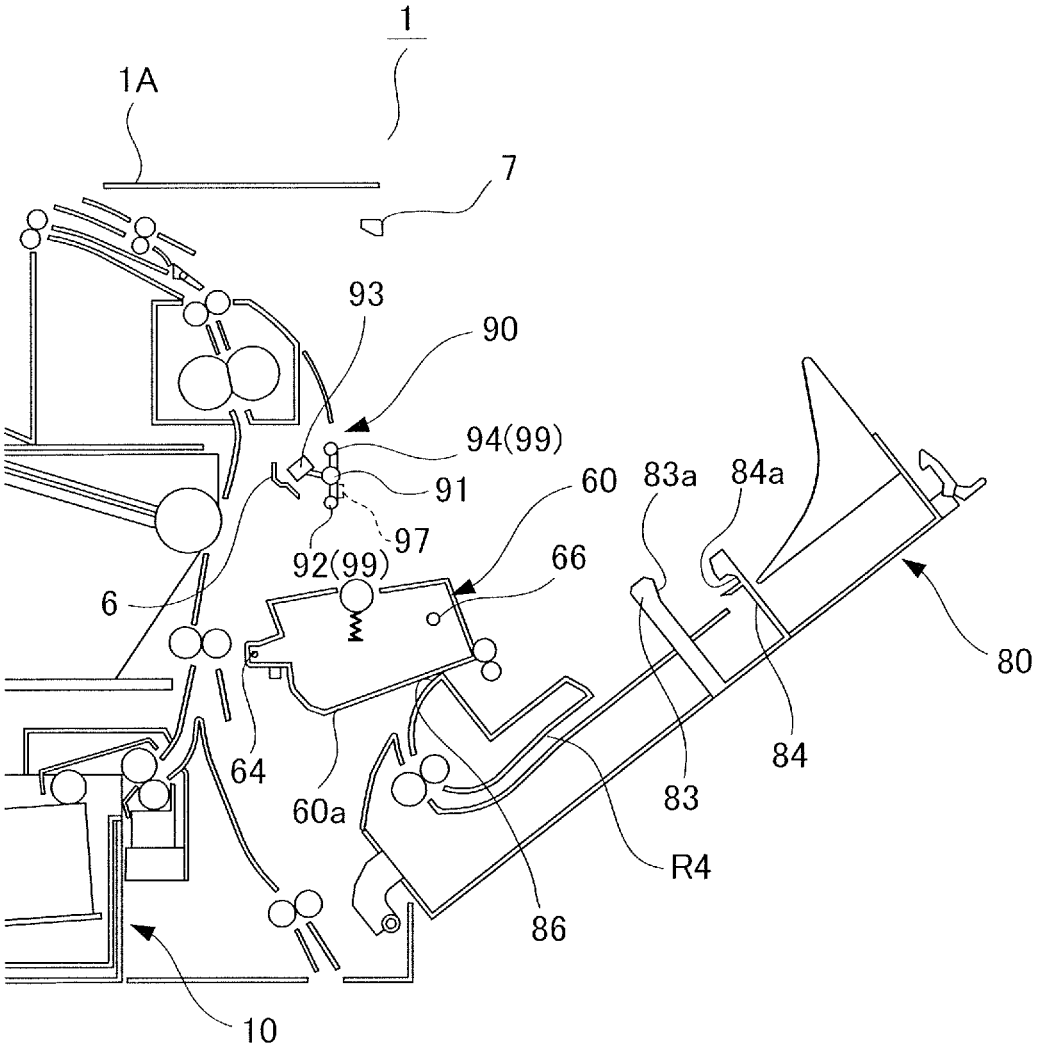
FIG. 3 is a diagram schematically illustrating a state in which the side door and the transfer unit are abutting each other.

The side door 80 is disposed further on the outer side in the apparatus body 1A than the transfer unit 60 in a horizontal direction, and is supported so as to be capable of being opened and closed with respect to the apparatus body 1A by being pivoted about a pivot shaft 81. In addition, in a closed state, the side door 80 is locked with respect to the apparatus body 1A as a result of engagement between a locking portion 7 provided in the apparatus body 1A and a hook portion 85 provided on the side door 80. As illustrated in FIG. 3, when a user tries to close the side door 80 to change the state of the side door 80 from an open state to a closed state, the frame 60*a* of the transfer unit 60 abuts a pushing-up portion 86 of the side door 80. To be noted, the pushing-up portion 86 is not provided on a guide constituting the duplex conveyance path R4, and is provided at a position displaced from the duplex conveyance path R4 in the width direction of the sheet S. Therefore, the pushing-up portion 86 does not damage a sheet conveyance region of the duplex conveyance path R4 and cause jamming of the sheet S.

In addition, the side door 80 includes a first projection portion 83 and a second projection portion 84 projecting toward the inside of the apparatus body 1A. The first projection portion 83 serves as a third engagement portion. The first projection portion 83 includes, on an upper surface of a distal end portion thereof, an inclined surface 83*a* inclined downwardly toward a proximal end portion thereof. The second projection portion 84 includes a recess portion 84*a* serving as a fourth engagement portion capable of engaging with a second boss 94 of a positioning cam 90.

Configuration of Positioning Cam

As illustrated in FIG. 3, the apparatus body 1A supports a positioning cam 90 such that the positioning cam 90 is capable of pivoting about a pivot shaft 91, and the positioning cam 90 includes a first boss 92, a second boss 94, and a pressing portion 93. The positioning cam 90 serving as a positioning portion is entirely disposed further on the outside of the apparatus body 1A than the pivot shaft 64 of the transfer unit 60, that is, on the side door 80 side. The first boss 92 serving as a first engagement portion extends toward a first side, i.e. in a first radial direction perpendicular to an axial direction of the pivot shaft 91 serving as a pivot center, and the second boss 94 serving as a second engagement portion extends toward a second side, i.e. in a second radial direction, from the pivot shaft 91. In addition, the pressing portion 93 extends toward a third side different from the first side and the second side, i.e. in the third radial direction, from the pivot shaft 91. The first boss 92 and the second boss 94 constitute an interlocking portion 99 that causes the positioning cam 90 to pivot along with an opening/closing operation of the side door 80. According to this configuration in which the first boss 92, the second boss 94, and the pressing portion 93 respectively extend from the pivot shaft 91 in radial directions, the positioning cam 90 can be miniaturized.

Figures 4A, 4B:
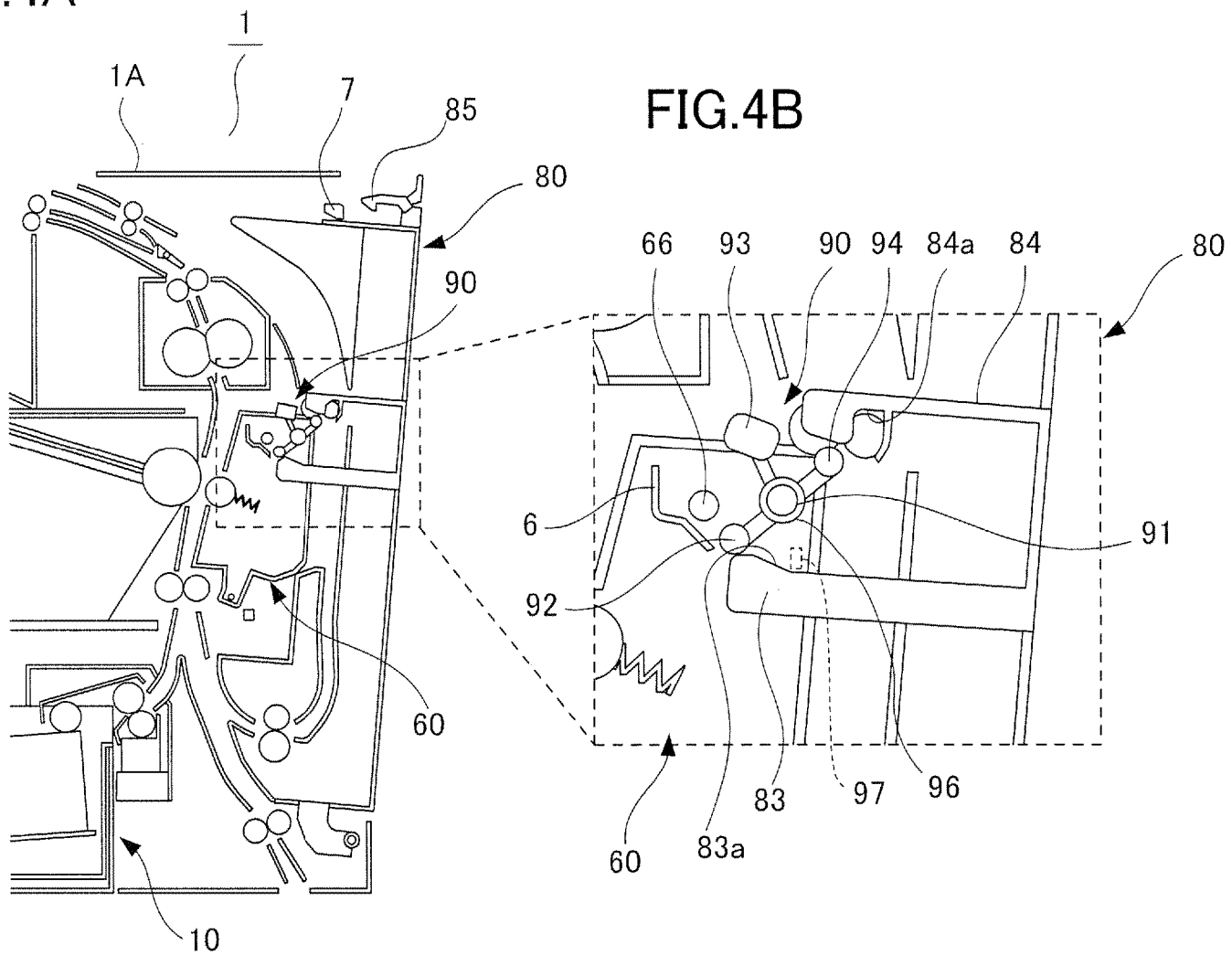
FIG. 4A is an overall view of a positioning cam when the side door is being closed.
FIG. 4B is an enlarged view of the positioning cam when the side door is being closed.

The positioning cam 90 is urged in a counterclockwise direction in FIG. 3 by a torsion coil spring 96 illustrated in FIG. 4B serving as an urging portion and wound around the pivot shaft 91, and is positioned at a position illustrated in FIG. 3 by a stopper 97 serving as a regulation portion. That is, the stopper regulates pivoting of the positioning cam 90 in the urging direction of the torsion coil spring 96. The first boss 92 is disposed such that the first boss 92 can be pressed by the first projection portion 83 of the side door 80 when the movement of the positioning cam 90 is regulated by the stopper 97.

Operation of Positioning Cam

Next, an operation of the positioning cam 90 will be described along with an opening/closing operation of the side door 80. Although the positioning cam 90 is illustrated to overlap the transfer unit 60 and the side door 80 in FIGS. 4A to 6B, the positioning cam 90 is disposed so as not to interrupt opening and closing of the transfer unit 60 and the side door 80. Specifically, although the pressing portion 93 of the positioning cam 90 is disposed at the same position as the positioning pin 66 and the body-side positioning portion 6 in a depth direction of FIG. 3, the other parts of the positioning cam 90 do not interfere with the transfer unit 60. In addition, although the first boss 92 and the second boss 94 of the positioning cam 90 are respectively disposed at the same positions as the first projection portion 83 and the second projection portion 84 of the side door 80 in the depth direction of FIG. 3, the other parts of the positioning cam 90 do not interfere with the side door 80.

First, an operation of the positioning cam 90 at the time of closing the side door 80 will be described. As illustrated in FIG. 3, when the side door 80 is closed by a user, the pushing-up portion 86 of the side door 80 comes into contact with the frame 60*a* of the transfer unit 60 as described above, and the transfer unit 60 is pushed up. As illustrated in FIGS. 4A and 4B, when the side door 80 is moved further toward the apparatus body 1A to close the side door 80, the first projection portion 83 of the side door 80 comes into contact with the first boss 92 of the positioning cam 90. As a result of the first boss 92 being pressed by the first projection portion 83, the positioning cam 90 pivots in a clockwise direction against the urging force of the torsion coil spring 96. As a result of this, the positioning cam 90 is held at a position at which the second boss 94 can engage with the recess portion 84*a* of the second projection portion 84.

Figures 5A, 5B:
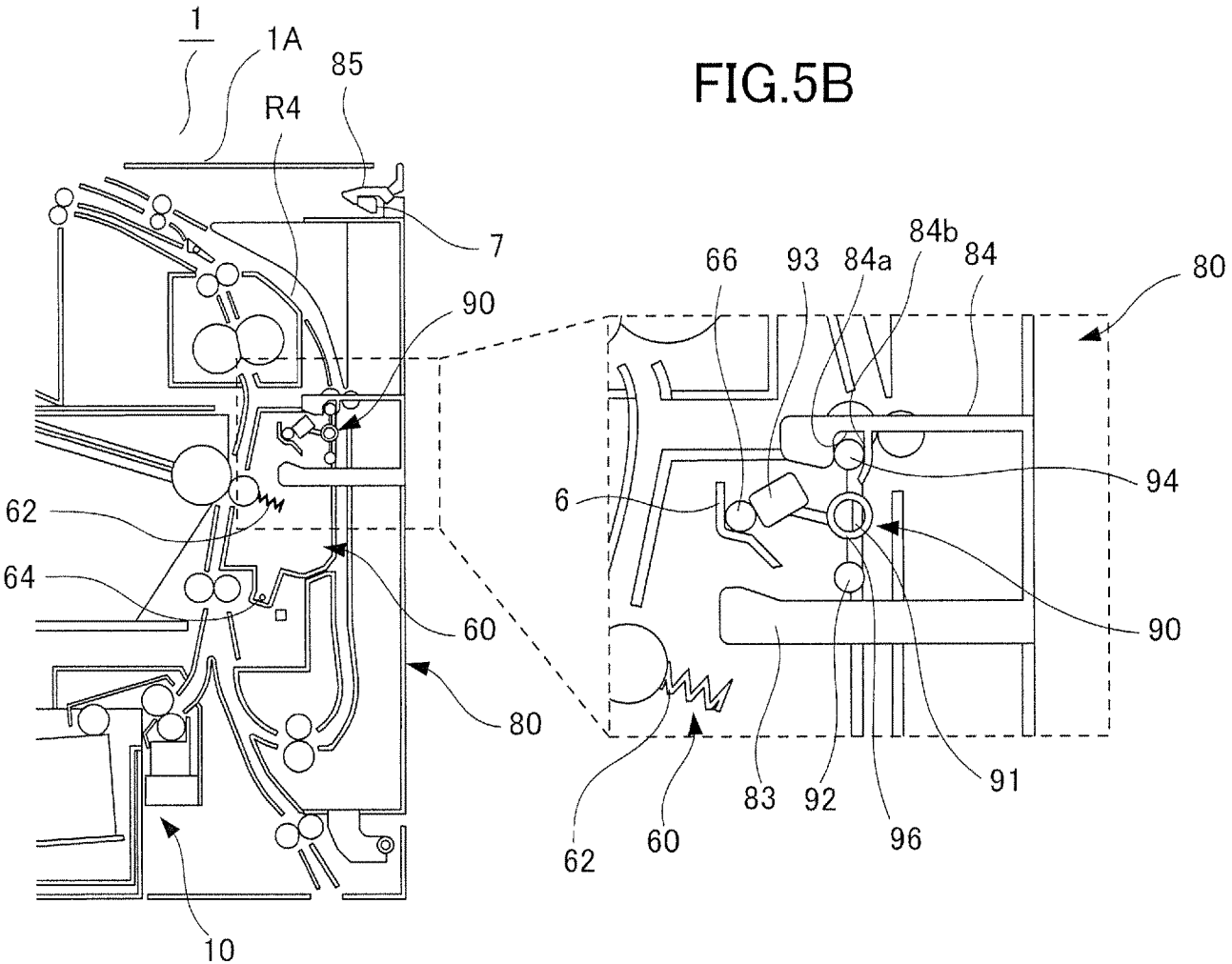
FIG. 5A is an overall view of the positioning cam with the side door in a closed state.
FIG. 5B is an enlarged view of the positioning cam with the side door in a closed state.

As illustrated in FIGS. 5A and 5B, when the side door 80 is moved further toward the apparatus body 1A to close the side door 80, the second boss 94 engages with the recess portion 84*a*, the second boss 94 is pressed by a first pressing surface 84*b* of the recess portion 84*a*, and thus the positioning cam 90 pivots in a counterclockwise direction. To be noted, when the positioning cam 90 engages with the recess portion 84*a* and pivots in the counterclockwise direction, the first boss 92 passes above the inclined surface 83*a* of the first projection portion 83 and thus does not interfere with the first projection portion 83.

Then, when the side door 80 is in a closed state, the locking portion 7 engages with the hook portion 85, and the side door 80 is locked with respect to the apparatus body 1A as illustrated in FIGS. 5A and 5B. At this time, the positioning pin 66 of the transfer unit 60 is pressed against the body-side positioning portion 6 by the pressing portion 93.

That is, the pressing portion 93 is urged in a counterclockwise direction about the pivot shaft 91 by a pressing force applied to the second boss 94 from the first pressing surface 84*b* and the urging force of the torsion coil spring 96, and presses the positioning pin 66 by this urging force. As a result of the positioning pin 66, of the transfer unit 60, being pressed against the body-side positioning portion 6 as described above, the transfer unit can be precisely positioned with respect to the apparatus body 1A.

Although a force to pivot the positioning pin 66 clockwise about the pivot shaft 64 by the transfer roller spring 62 is applied to the positioning pin 66, force required for a user to close the side door 80 can be reduced by providing the torsion coil spring 96. In addition, by forming the first pressing surface 84*b* as a thin body such that the first pressing surface 84*b* is likely to be elastically deformed, the pressing portion 93 can press the second boss 94 without fail. In addition, the positioning cam 90 is disposed between the first projection portion 83 and the second projection portion 84 in the vertical direction when the side door 80 is in the closed state. Therefore, the positioning cam 90 can be disposed in a limited space, and thus the printer 1 can be miniaturized.

Figures 6A, 6B:
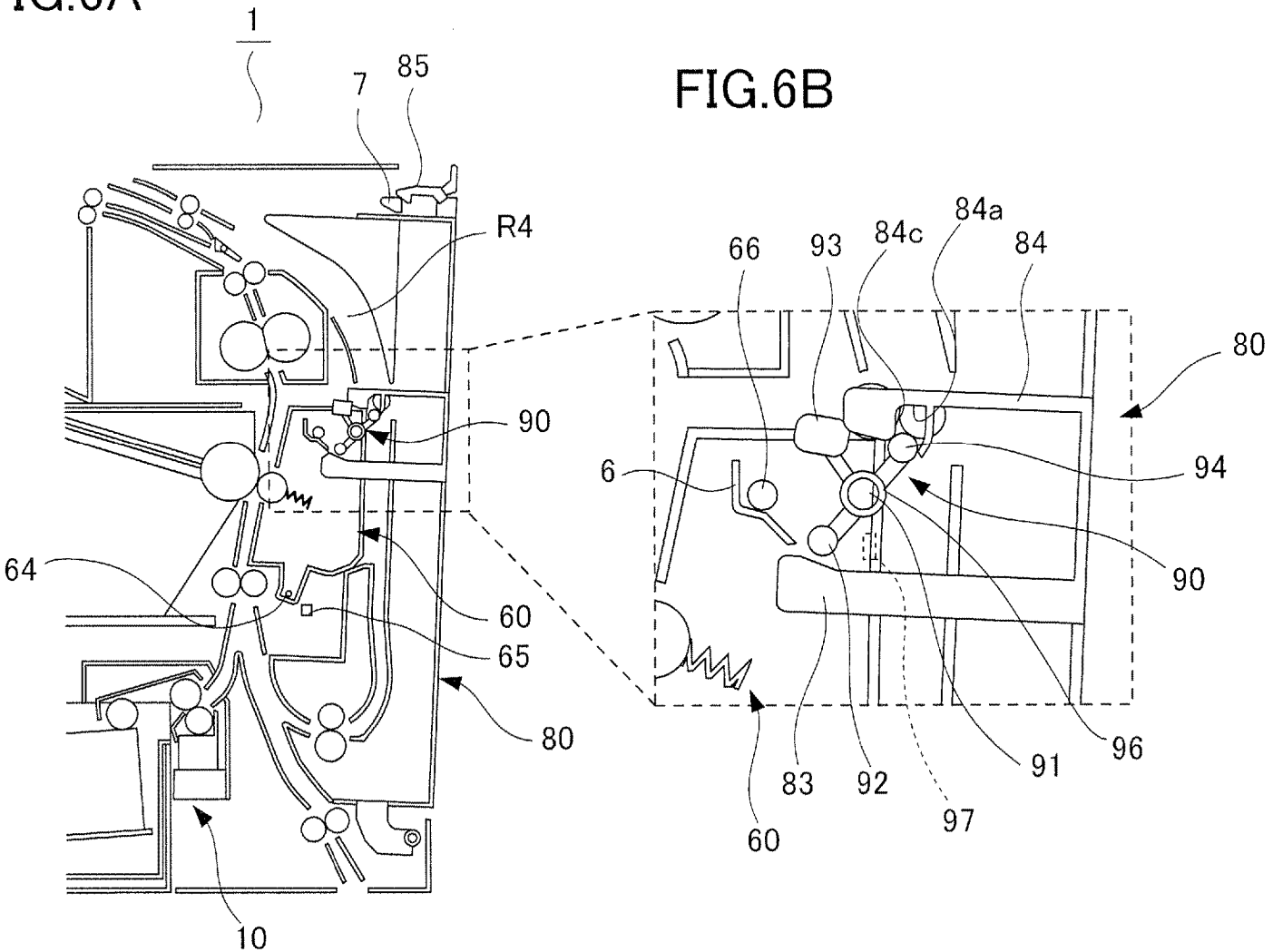
FIG. 6A is an overall view of the positioning cam when the side door is being opened.
FIG. 6B is an enlarged view of the positioning cam when the side door is being opened.

Next, an operation of the positioning cam 90 at the time of opening the side door 80 will be described. When the side door 80 is opened by a user, a second pressing surface 84*c* opposing the first pressing surface 84*b* of the recess portion 84*a* presses the second boss 94 as illustrated in FIGS. 6A and 6B, and thus the positioning cam 90 pivots clockwise against the urging force of the torsion coil spring 96. As a result of the positioning cam pivoting clockwise about the pivot shaft 91, the pressing portion 93 is separated from the positioning pin 66 of the transfer unit 60, and the transfer unit 60 takes a state in which the transfer unit 60 can pivot about the pivot shaft 64.

When the side door 80 is moved farther from the apparatus body 1A by opening the side door 80, opening of the transfer unit 60 proceeds with opening of the side door 80 by its own weight, and the second boss 94 comes out of the recess portion 84*a*. After the second boss 94 comes out of the recess portion 84*a*, the positioning cam 90 pivots counterclockwise about the pivot shaft 91 due to the torsion coil spring 96, abuts the stopper 97, and stops. Then, when opening of the side door 80 is further proceeded by the user, the side door 80 is opened to an angle of approximately 90° as illustrated in FIG. 2, and the transfer unit 60 is held by the stopper 65.

In this state, the user can close the transfer unit 60 with respect to the apparatus body 1A separately from the side door 80. The user can cause the positioning pin 66 to abut the body-side positioning portion 6 by lifting up the transfer unit 60. At this time, the positioning pin 66 abuts the pressing portion 93 of the positioning cam 90 from below, and the pressing portion 93 is slightly lifted up. Then, the positioning pin 66 is held at a position illustrated in FIGS. 5A and 5B. The pressing portion 93 can hold the positioning pin 66 by the urging force of the torsion coil spring 96. That is, in a state in which the positioning pin 66 is held by the pressing portion 93, the urging force applied to the positioning pin 66 by the torsion coil spring 96 is set to be larger than the urging force applied to the positioning pin 66 by the transfer roller spring 62. As described above, the user can close the transfer unit 60 from the side door 80 in a state in which the side door 80 is open, and thus the user can access a space between the transfer unit 60 and the side door 80 and the maintainability can be improved.

As described above, when the side door 80 is opened, the transfer unit 60 is opened along with the side door 80, and thus the transfer roller 61 is separated from the photosensitive drum 21. As a result of this, a user can easily remove a jammed sheet.

In addition, when the side door 80 is in the closed state, the positioning pin 66 of the transfer unit 60 is pressed against the body-side positioning portion 6 by the pressing portion 93 of the positioning cam 90, and thus the transfer unit 60 can be precisely positioned with respect to the apparatus body 1A. Accordingly, the transfer roller 61 can be urged toward the photosensitive drum 21, and thus the toner image can be securely transferred onto the sheet S.

In addition, as a result of entirely disposing the positioning cam 90 further on the outside of the apparatus body 1A than the pivot shaft 64 of the transfer unit 60, a configuration in which the positioning cam 90 is not provided in a limited space surrounded by the image forming portion 20, the transfer unit 60 and the fixing unit 40 can be employed. Accordingly, the apparatus body 1A can be miniaturized.

Second Exemplary Embodiment

Next, a second exemplary embodiment of the present invention will be described. In the second exemplary embodiment, the positioning cam 90 has a different configuration from the first exemplary embodiment. Therefore, illustration of the same elements as in the first exemplary embodiments will be omitted or described by adding the same reference signs thereto.

Figures 7A, 7B:
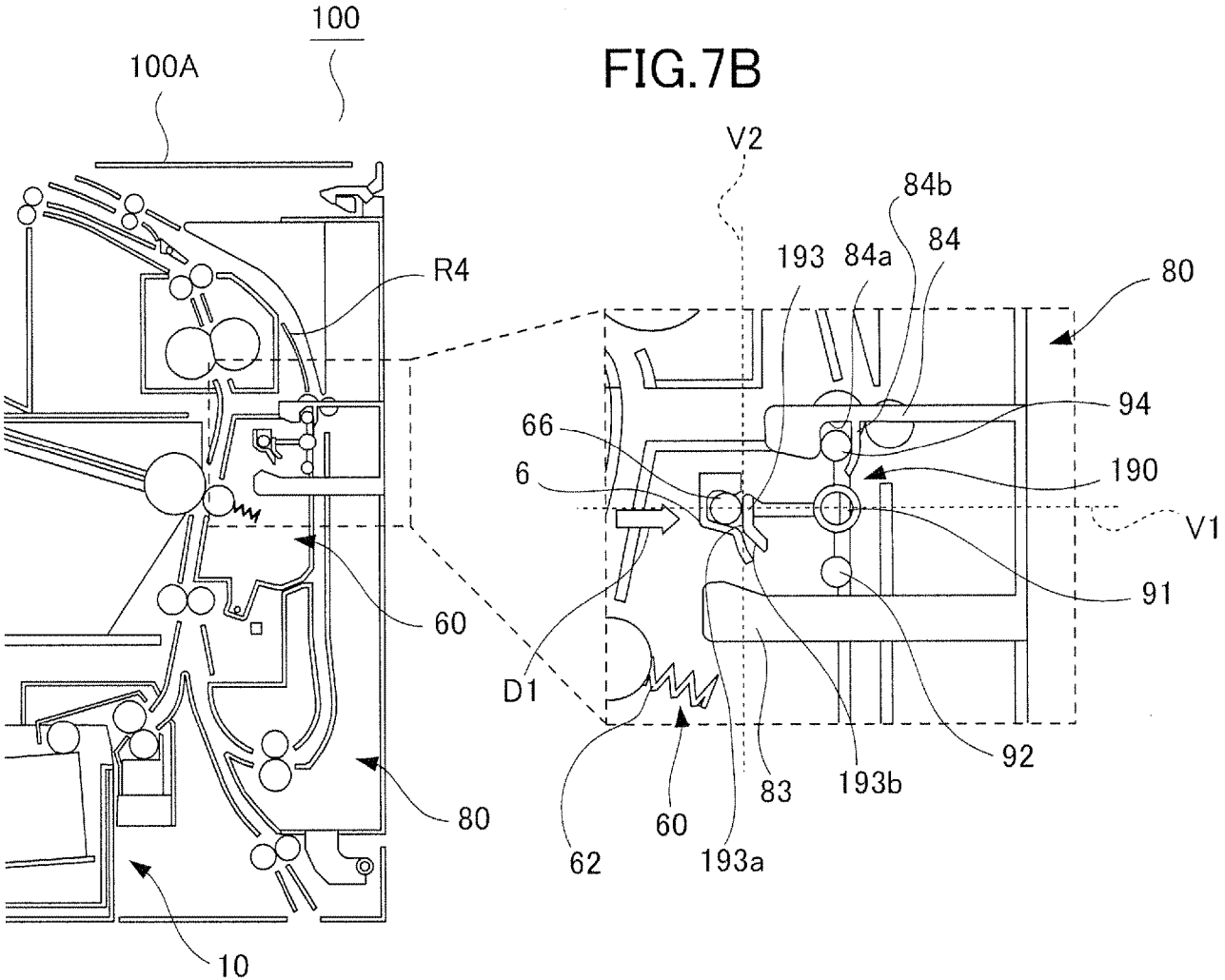
FIG. 7A is an overall view of a positioning cam according to a second exemplary embodiment.
FIG. 7B is an enlarged view of the positioning cam according to the second exemplary embodiment.
Figure 8A:
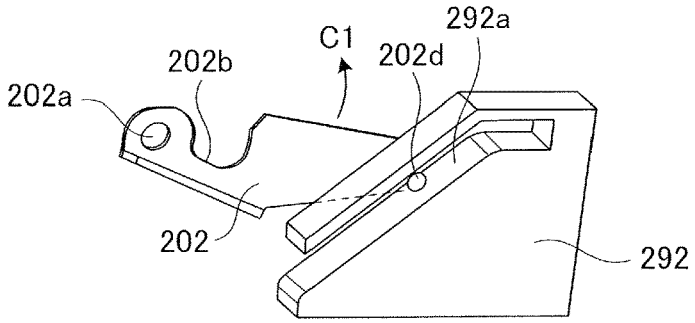
FIG.8A PRIOR ART
FIG. 8A is a perspective view of a conventional secondary transfer unit and a conventional secondary transfer locking arm.
Figure 8B:
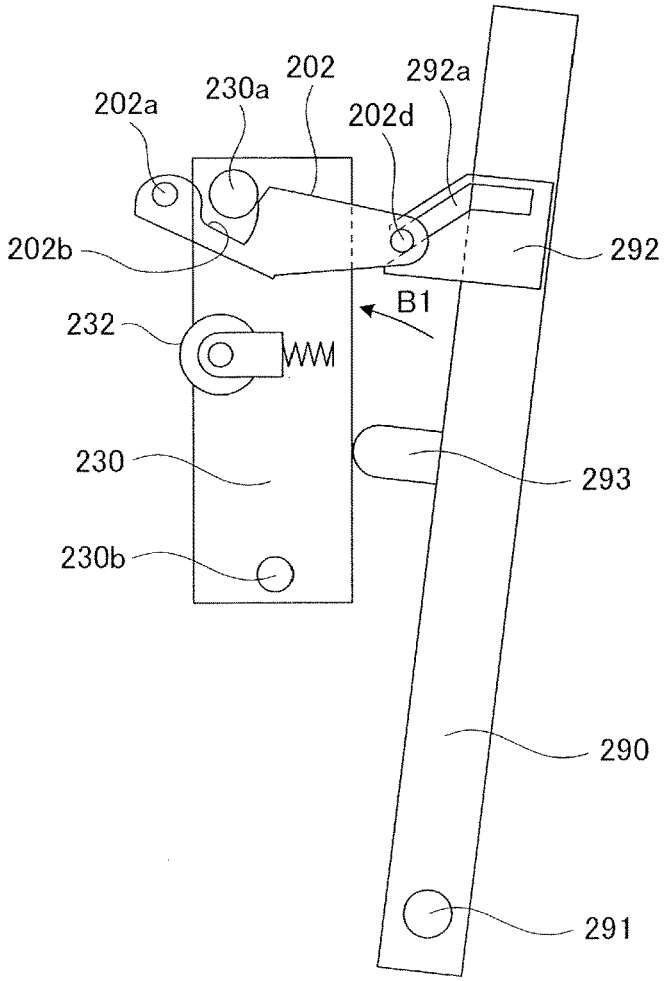
FIG.8B PRIOR ART
FIG. 8B is a side view of the conventional secondary transfer unit and the conventional secondary transfer locking arm.

As illustrated in FIGS. 7A and 7B, a positioning cam 190 is supported so as to be pivotable about the pivot shaft 91 with respect to an apparatus body 100A of a printer 100 serving as an image forming apparatus. The positioning cam 190 serving as a positioning portion is entirely disposed further on the outside of the apparatus body 100A than the pivot shaft 64 of the transfer unit 60, that is, on the side door 80 side. The positioning cam 190 includes the first boss 92, the second boss 94, and a pressing portion 193. The pressing portion 193 includes a pressing surface 193*a* and a bent surface 193*b*. The pressing surface 193*a* is capable of pressing the positioning pin 66 of the transfer unit 60, and the bent surface 193*b* extends from the pressing surface 193*a* in a warped manner. The operation of the positioning cam 190 at the time of opening and closing the side door 80 is similar to the operation of the positioning cam 90 in the first exemplary embodiment, and thus the description thereof is omitted herein.

When the side door 80 is in the closed state, the positioning pin 66 of the transfer unit 60 is pressed against the body-side positioning portion 6 by the pressing surface 193*a* of the pressing portion 193. At this time, the pressing surface 193*a* extends along a line V2 perpendicular to a line V1 connecting the pivot shaft 91 of the positioning cam 190 and the positioning pin 66. Therefore, the pressing surface 193*a* receives a reaction force in an arrow D1 direction from the positioning pin 66. The arrow D1 direction is a direction from the pressing portion 193 toward the pivot shaft 91 of the positioning cam 190.

That is, no rotational force is applied to the positioning cam 190 due to the reaction force, and thus no large load is applied onto the first pressing surface 84*b* of the recess portion 84*a*. Therefore, the transfer unit 60 can be stably positioned with respect to the apparatus body 100A even in the case where, for example, the transfer roller spring 62 is replaced by a spring that applies a higher transfer pressure.

To be noted, although a configuration in which the transfer unit 60 is opened along with the side door 80 when the side door 80 is opened is employed in the exemplary embodiments described above, a configuration in which the transfer unit 60 is not opened when the side door 80 is opened may be also employed.

In addition, although a printer that forms a monochromatic toner image is used in the exemplary embodiments described above, the present invention may be applied to a full-color printer that includes an intermediate transfer belt. For example, the present invention can be applied to a case where a secondary transfer member that transfers a toner image from an intermediate transfer belt onto a sheet is configured as a transfer unit pivotable with respect to an apparatus body.

In addition, although the positioning cam 90 or 190 is urged by the torsion coil spring 96 in the exemplary embodiments described above, the positioning cam 90 or 190 may be configured to, for example, be brought into contact with the stopper 97 by its own weight, and the torsion coil spring 96 may be removed.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-229463, filed Nov. 25, 2016, which is hereby incorporated by reference herein in its entirety.

What is claimed is:

1. An image forming apparatus comprising:

an apparatus body comprising an image bearing member configured to bear a toner image;

a transfer unit comprising a transfer portion configured to transfer the toner image on the image bearing member onto a sheet, the transfer unit being pivotably supported with respect to the apparatus body such that the transfer portion is capable of coming into contact with and being separated from the image bearing member;

an opening/closing unit disposed at a position farther from the apparatus body than the transfer unit is, and openably and closably supported with respect to the apparatus body;

a positioning portion provided on the apparatus body, pivotably supported with respect to the apparatus body and configured to position the transfer unit with respect to the apparatus body; and an urging portion configured to urge the positioning portion so as to pivot, wherein the transfer unit comprises an abutting portion configured to abut a fixed portion provided in the apparatus body, and is configured to be positioned with respect to the apparatus body as a result of the abutting portion abutting the fixed portion, wherein the positioning portion comprises:

a first engagement portion configured to engage with the opening/closing unit at a first position;

a second engagement portion configured to engage with the opening/closing unit at a second position further from a pivot center of the transfer unit than the first position; and a pressing portion configured to press the abutting portion, and wherein the opening/closing unit comprises:

a third engagement portion configured to press the first engagement portion and cause the positioning portion to pivot such that the pressing portion is separated from the abutting portion in a course of a closing operation of the opening/closing unit; and a fourth engagement portion configured to engage with the second engagement portion and cause the positioning portion to pivot.

2. The image forming apparatus according to claim 1, wherein the urging portion urges the positioning portion such that the pressing portion presses the abutting portion in a case where the opening/closing unit is in a closed state.

3. The image forming apparatus according to claim 2, wherein the third engagement portion is configured to cause the positioning portion to pivot against an urging force of the urging portion such that the second engagement portion is at a position at which the second engagement portion is capable of engaging with the fourth engagement portion in a course of the closing operation of the opening/closing unit.

4. The image forming apparatus according to claim 2, wherein the fourth engagement portion comprises:

a first pressing surface configured to press the second engagement portion when the opening/closing unit is being closed; and a second pressing surface opposing the first pressing surface, and wherein the second pressing surface of the fourth engagement portion is configured to cause, via the second engagement portion, the positioning portion to pivot against an urging force of the urging portion such that the pressing portion is separated from the abutting portion in a course of an opening operation of the opening/closing unit.

5. The image forming apparatus according to claim 1, further comprising a regulation portion configured to regulate pivoting of the positioning portion in an urging direction of the urging portion, wherein the pressing portion is configured to abut the abutting portion and hold the transfer unit in a state in which movement of the positioning portion is regulated by the regulation portion.

6. The image forming apparatus according to claim 1, wherein the pressing portion receives a reaction force in a direction from the abutting portion toward a pivot center of the positioning portion in a case where the opening/closing unit is in a closed state.

7. The image forming apparatus according to claim 6, wherein the pressing portion comprises a pressing surface extending along a line perpendicular to a line connecting the pivot center of the positioning portion and the abutting portion, and receiving the reaction force in a case where the opening/closing unit is in the closed state.

8. The image forming apparatus according to claim 1, wherein the positioning portion is disposed between the third engagement portion and the fourth engagement portion in a vertical direction in a case where the opening/closing unit is in a closed state.

9. The image forming apparatus according to claim 1, wherein the transfer unit comprises a transfer urging portion configured to urge the transfer portion toward the image bearing member.

10. An image forming apparatus comprising:

an apparatus body comprising an image bearing member configured to bear a toner image;

a transfer unit comprising a transfer portion configured to transfer the toner image borne on the image bearing member onto a sheet, the transfer unit being pivotably supported with respect to the apparatus body such that the transfer portion is capable of coming into contact with and being separated from the image bearing member;

an opening/closing unit disposed at a position farther from the apparatus body than the transfer unit is, and openably and closably supported with respect to the apparatus body; and a positioning portion pivotably supported with respect to the apparatus body and configured to position an abutting portion of the transfer unit with respect to a fixed portion provided in the apparatus body, wherein the positioning portion comprises:

a first engagement portion extending toward a first side from a pivot center of the positioning portion;

a second engagement portion extending toward a second side from the pivot center of the positioning portion; and a pressing portion extending toward a third side different from the first side and the second side from the pivot center of the positioning portion, and configured to press the abutting portion of the transfer unit against the fixed portion, and wherein the opening/closing unit comprises:

a third engagement portion configured to press the first engagement portion and cause the positioning portion to pivot such that the pressing portion is separated from the abutting portion in a course of a closing operation of the opening/closing unit; and a fourth engagement portion configured to engage with the second engagement portion and cause the positioning portion to pivot such that the pressing portion approaches the abutting portion in a course of the closing operation of the opening/closing unit.

11. The image forming apparatus according to claim 1, wherein the first engagement portion extends toward a first side from a pivot center of the positioning portion, and wherein the second engagement portion extends toward a second side from the pivot center of the positioning portion.

* * * * *